US005481955A

United States Patent [19]

Goto

[11] Patent Number: 5,481,955

[45] Date of Patent: Jan. 9, 1996

[54] TREMOLO DEVICE

[75] Inventor: Takao Goto, Gunmaken, Japan

[73] Assignee: Gotoh Gut Yugen Kaisha, Gunmaken, Japan

[21] Appl. No.: 354,077

[22] Filed: Dec. 6, 1994

[30] Foreign Application Priority Data

Dec. 30, 1993 [JP] Japan ..... 5-355092

[51] Int. Cl.[6] ..... G10D 3/00

[52] U.S. Cl. ..... 84/313

[58] Field of Search ..... 84/298, 299, 313

[56] References Cited

U.S. PATENT DOCUMENTS 4,638,711 1/1987 Stroh ..... 84/313

FOREIGN PATENT DOCUMENTS 63-48079 9/1988 Japan .
63-36375 9/1988 Japan .

*Primary Examiner*—Patrick J. Stanzione
*Attorney, Agent, or Firm*—Wenderoth, Lind & Ponack

[57] ABSTRACT

A tremolo device for a stringed instrument includes internal walls of a string inserting hole and a through hole of a base communicating with the string inserting hole formed by sloped surfaces and along a direction of extension of a string. The string can be extended freely through the through hole and the string inserting hole without contact with the insides of such holes, so that the string can be tautly extended in a straight line between a string engaging part and a pedestal. Thus, it is possible to prevent strings from being broken due to frictional wear and habitual deformation due to continuous folding.

3 Claims, 2 Drawing Sheets

TREMOLO DEVICE

BACKGROUND OF THE INVENTION

The present invention relates to a tremolo device for use in a stringed instrument.

A tremolo device includes a base which is provided with a required number of pedestals for adjusting strings in an array and is adapted to be turnable in a direction such that it moves toward and away from a surface of a stringed instrument with its front edge side as a pivot. A block extends at a right angle from the base and serves to engage ends of strings. A handle arm is provided for turning the base. A tremolo device as described above is disclosed, for example, in Japanese Utility Model Publication Gazette SHO. 63-36375.

Such prior tremolo device is constructed so that as many string inserting holes as a required number of strings are formed to pass through the block, strings are inserted through respective string inserting holes, fasteners are provided at the ends of the strings to fasten the strings to receiving parts at the lower ends of the respective string inserting holes, and the strings are engaged with the pedestals arranged on the base and tensioned by string reeling tools at the head of the stringed instrument.

In such prior tremolo device, the string inserting holes provided in the block are formed to be orthogonal to the base. Therefore, if a through hole in the base communicates with the string inserting hole and has the same diameter as that of the string inserting hole, the string is forcibly depressed to the edge of the hole. If the through hole has a larger diameter than that of the string inserting hole, the string is forcibly depressed to the edge of the string inserting hole. When the string is depressed onto the hole edge, the string is forcibly bent at the position of depression and evidence of such bend will remain at the position of depression. Therefore, there is a problem that, if the base is turned up during tremolo playing of the stringed instrument, the evidence of bend of the string increases frictional resistance between the string and the hole edge. The string can be snapped due to excessive friction. The evidence of bend hinders sliding of the string around the hole edge by its frictional force. Therefore, the base is prevented from returning to a home position, thus distributing tuning. In addition, there is a problem that, since a portion of the string which is made to forcibly contact the hole edge, that is the portion with the evidence of bend, forms a fulcrum, the length of string extended between the string receiving surface of the pedestal and the string fastener is oscillationally reduced by the fulcrum, and therefore a sustaining tone is shortened.

SUMMARY OF THE INVENTION

An object of the present invention is to provide a tremolo device capable of preventing strings from being broken due to friction at the hole edges.

Another object of the present invention is to prevent the strings from being deformed due to habitual folding at the hole edges.

In the tremolo device according to the present invention, the through holes which are provided to pass through the base and the string inserting holes of the block which are provided to communicate with the through holes respectively formed as continuous sloped surfaces formed along strings extended between string engaging parts of the string inserting holes engaged with fasteners or holding members provided at the string ends and string receiving members provided on the pedestal for adjusting the strings.

Each hole wall of the string inserting hole and the through hole nearby the string receiving member are sloped to expand from the string fastener toward a string lead-out side between the string receiving member and the string engaging part of the pedestal.

In the present invention, it suffices to form each string extension passage respectively formed by the string inserting hole and the through hole as a space which permits straight extension of each string. Therefore, the wall of the string inserting hole can be partly cut away to provide a window.

Also in the present invention, it is preferable to form a string receiving surface of the spring receiving member as an external surface of a roller. Thus, a frictional force added to the string at the string receiving surface can be further reduced.

Since the present invention is constructed as described above, the string is extended in an inclined manner to be free in a space between the string receiving surface and the string engaging part and does not come into contact with the edge of the through hole, even when the pedestal is retracted. Therefore, the string can be always kept straightly tensioned.

PREFERRED EMBODIMENT OF THE INVENTION

Figure 1:
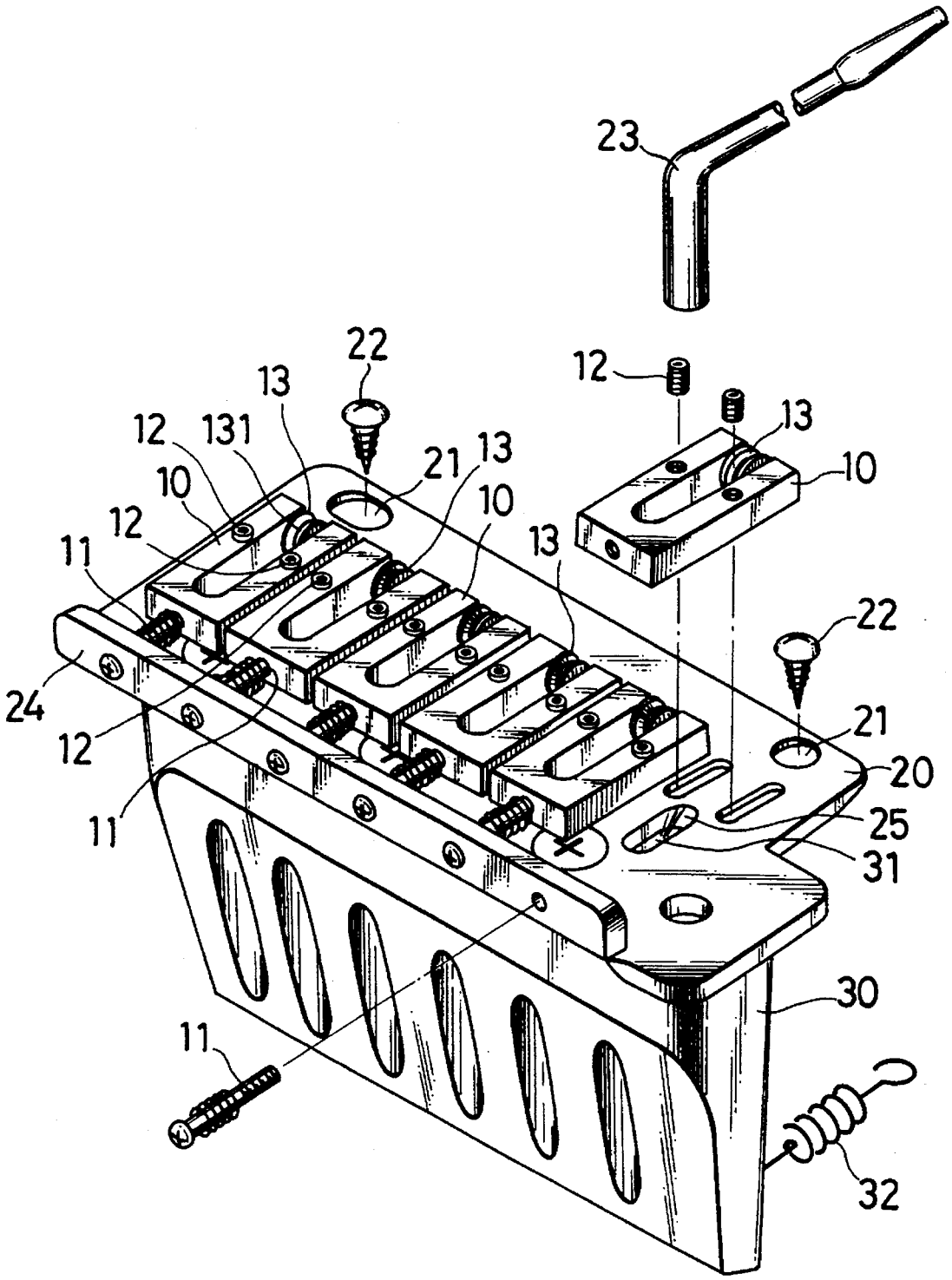
Fig. 1 is a perspective view of a tremolo device according to the present invention.
Figure 2:
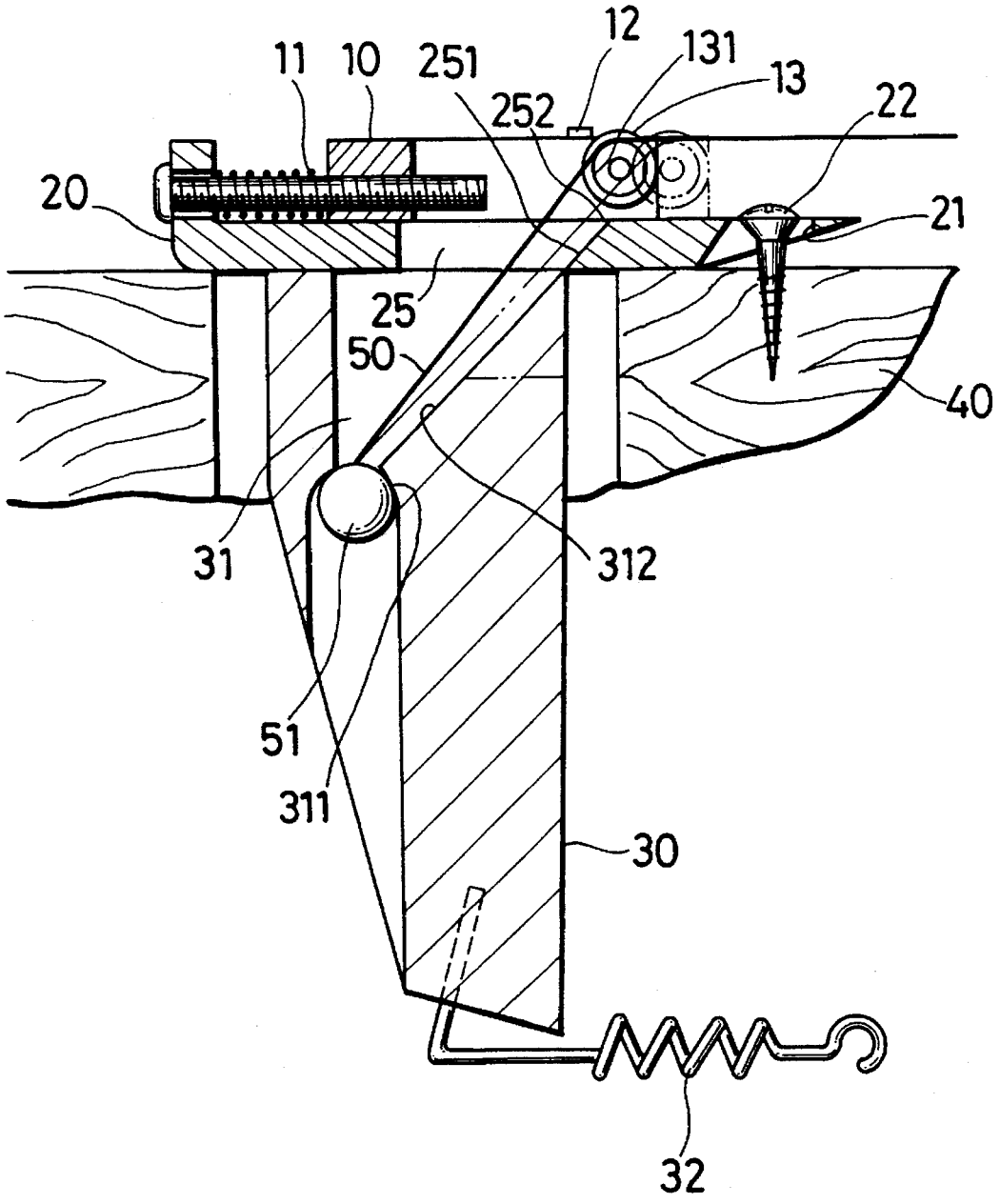
FIG. 2 is a vertical sectional view thereof.

The tremolo device according to the present invention comprises a base 20 on which are arranged a required number of pedestals 10. A block 30 for engaging ends of strings of a stringed instrument is orthogonally coupled to a lower surface of the base 20, as shown in FIG. 1. As shown in FIG. 2, the base 20 is constructed so that it is overlappingly secured to a body 40 of the stringed instrument to be contacted or not contacted therewith. Engaging through holes 21 are provided at both sides of a front end edge opposed to a head end of the stringed instrument, whereby the base 20 can be turned to move toward and away from the body, with pivots defined by support bolts 22 extending through engaging holes 21 as shown in FIG. 2, by operating an arm 23. The plurality of pedestals 10 provided on the base 20 are thread-engaged with respective long screws 11 thread-fitted to a tail portion 24 of the base 20, to be movable in a direction of extension of respective string 50, and are provided with adjust screws 12 so as to be individually adjustable in height. This construction of the pedestals 10 is the same as that of the prior known pedestal.

The block 30 has therethrough a plurality of string inserting hole 31 corresponding to the pedestals 10. A reset spring 32 serves to retract the block 30 at all times to secure the base 20 on the body 40. The string inserting holes 31 are provided with respective string engaging parts 311 for engaging fasteners or string holding members 51 provided at the ends of strings 50. The base 20 is provided with through holes 25 which communicate with respective string inserting holes 31, and string extension passages are formed by the through holes 25 and the string inserting holes 31. In addition, the pedestals 10 are provided with respective string receiving members 13 for receiving the strings 50 led out from the string inserting holes 31 and the through holes 25, and string receiving surfaces 131 are formed on the string receiving members 13. The strings 50 are wound around pegs, not shown, at the head end of the stringed instrument, pass over the string receiving surfaces 131, and are tensioned between the string engaging parts 311 of the string inserting holes 31 and the pegs.

The hole walls of the string inserting holes 31 near the string engaging parts 311 and the through holes 25 near the string receiving surfaces 131 respectively form continuous inclined or sloped surfaces 251 and 312. Therefore, the strings 50 extend in an inclined manner without contacting the hole walls in the space between the string engaging parts 311 and the string receiving surfaces 131. The wall of the string inserting hole 31 can be partly cut away to provide a window as shown by a broken line in FIG. 2.

Though the string receiving members 13 on the pedestals can be formed to be trapezoidal, it is preferable to form the string receiving members 13 by using rotatable rollers. Thus, a frictional resisting force produced by the string receiving members 131 upon sliding therealong of the strings 50 can be reduced and abrasion of the strings 50 can be reduced. When the string receiving members 13 thus are formed as rollers, it is preferable to form a groove at the center of the external surface of each roller and to employ such groove as the respective string receiving surface 131.

The tremolo device according to the present invention provides an effect that the strings 50 are straightly extended in the spaces between the string engaging parts 311 and the string inserting holes 31 and the stringing receiving surfaces 131 of the string receiving members 13 when the pedestal 10 is retracted as shown by solid lines in FIG. 2 and advanced as shown by broken lines in FIG. 2. Therefore, it is possible to surely eliminate those disadvantages of the prior tremolo device such as breakage of strings caused by forced depression thereof to the hole edges, failure of returning of the base to the home position thereof and hindrance to the effect of sustaining tone.

We claim:

1. A tremolo device comprising:

a base on which are arranged a required number of pedestals respectively provided with string receiving members;

a block for engaging ends of strings, said block being coupled at A right angle to said base;

said block being provided with string inserting holes for inserting and engaging ends of the strings;

said base being provided with through holes which communicate with respective said string inserting holes; and said string inserting holes and said through holes being constructed to define string extension passages in which strings are straightly extended to be free between respective string engaging parts of said string inserting holes and respective string receiving surfaces of said string receiving members.

2. A tremolo device according to claim 1, wherein the walls of each said string inserting hole and the respective said through hole are sloped along a string extension direction.

3. A tremolo device according to claim 1, wherein said string receiving members are formed as rollers each of which is provided on an external periphery thereof with a groove as said respective string receiving surface.

* * * * *